US005853255A

United States Patent [19]

Soshi et al.

[11] Patent Number: 5,853,255

[45] Date of Patent: Dec. 29, 1998

[54] THERMAL PRINTER AND INK RIBBON USED THEREWITH

[75] Inventors: Hiroyuki Soshi; Mitsuhiro Hamashima, both of Tokyo-to, Japan

[73] Assignee: Dai Nippon Printing Co., Ltd., Tokyo-to, Japan

[21] Appl. No.: 785,995

[22] Filed: Jan. 21, 1997

[30] Foreign Application Priority Data

Jan. 19, 1996 [JP] Japan ..... 8-024811
Apr. 25, 1996 [JP] Japan ..... 8-127672

[51] Int. Cl.[6] ..... B41J 35/16

[52] U.S. Cl. ..... 400/237; 400/120.07; 400/240

[58] Field of Search ..... 400/120.07, 120.02, 400/237, 240, 240.3, 240.4, 238

[56] References Cited

U.S. PATENT DOCUMENTS 5,035,325 7/1991 Kitsuki ..... 206/459

FOREIGN PATENT DOCUMENTS 0506144 9/1992 European Pat. Off. ..... B41J 2/36
0562979 9/1993 European Pat. Off. ..... B41J 17/36
0645251 3/1995 European Pat. Off. ..... B41J 17/32
2716412 8/1995 France ..... B41J 31/00
150781 8/1984 Japan ..... 400/240
6-3224980 9/1988 Japan ..... B41J 17/32
6-3264374 11/1988 Japan ..... B41J 3/20
1067368 3/1989 Japan ..... B41J 17/00
70474 3/1990 Japan ..... 400/240
270584 11/1990 Japan ..... 400/240
5193222 8/1993 Japan ..... B41J 17/32
262787 9/1994 Japan ..... 400/240
7-01752 1/1995 Japan ..... B41J 2/325
7101108 4/1995 Japan ..... B41J 5/30
7251541 10/1995 Japan ..... B41J 17/36
9524316 9/1995 WIPO ..... B41J 2/315

*Primary Examiner*—Edgar Burr
*Assistant Examiner*—Steven S. Kelley
*Attorney, Agent, or Firm*—Ladas & Parry

[57] ABSTRACT

A gradation correction data used in correcting the gradation of the printed image is recorded on the leader film of the ink ribbon in a form of optically readable marks. Then the ink ribbon is set in a thermal printer, the marks are read out by an optical sensor to obtain the gradation correction data. Then, the gradation correction of the image data to be printed is carried out by referring to the correction data thus obtained prior to the actual printing of the image data.

12 Claims, 9 Drawing Sheets

| GRADATION STEP | Y | M | C | K |
|---|---|---|---|---|
| 15 | +5 | +2 | +4 | −3 |
| 63 | +3 | +6 | +2 | −2 |
| 127 | 0 | +3 | +5 | −2 |
| 191 | +1 | +3 | 0 | 0 |
| 255 | −5 | 0 | +2 | 0 |

| OFFSET | +2 |
|---|---|

THERMAL PRINTER AND INK RIBBON USED THEREWITH

BACKGROUND OF THE INVENTION

1. Field of the Invention

The present invention relates to a sublimation transfer type thermal printer and ink ribbon used by the printer, and more particularly relates to the technique of stabilizing the print quality by making a precise control of the print density.

2. Description of the Prior Art

The sublimation transfer type thermal printer has an ability to achieve smooth and natural gradation expression, and is characterized by its excellent expressiveness, high print quality and natural image reproducibility. In this view, it is frequently used for the special purpose which requires printing of high quality and high fidelity, such as an output of printed matter for the correction, medical printings such as CT-scanner or radiograph, or color samples of products in the apparel industry or other industry. In such cases, simply printing the original image data does not satisfy the requirement of special printing quality. Therefore, in such cases, the original image data is corrected to compensate for the variation of the ink ribbon characteristics, and the corrected image data is printed.

The variation in characteristic of the ink ribbons result in the problem that an appropriate normal gradation with respect to the print density cannot be reproduced, even if the printing condition of the thermal printer is uniform. Particularly, in the color printing, all colors are reproduced by superposing the images of three primary colors (Yellow, Magenta and Cyan) or four primary colors (Y, M, C, and Black) by using the ink ribbons of those colors. Therefore, if the normal gradation reproduction is not ensured in at least one color, the color balance is broken and high fidelity reproduction may not be achieved. In this view, the gradation correction is performed. Conventionally, the manufacturer of the ink ribbon performs test printing for respective lot of the ink ribbons, measures the print density of the test printing to calculate the correction data, and sells the ink ribbon product with the correction data sheet or the like attached. The user of the ink ribbon inputs the correction data to his printing system or image processing system via keyboard or the like to make the appropriate gradation correction, before starting the printing.

However, in such a case, the user needs to input the correction data by manual operation every time when he exchange the ink ribbon, and it is very time-consuming and troublesome. Moreover, there is relatively large possibility of erroneously inputting the correction data because many correction values should be inputted.

SUMMARY OF THE INVENTION

It is an object of the present invention to provide an ink ribbon and a thermal printer in which the correction data is automatically inputted to the thermal printer by simply setting the ink ribbon to the printer.

According to one aspect of the present invention, there is provided an ink ribbon for use in a sublimation transfer type thermal printer, including: an ink ribbon body portion which is coated with color ink; and an ink ribbon head portion on which gradation correction data is recorded. According to this ink ribbon, the gradation correction data is recorded at the head portion of the ink ribbon, and therefore the gradation correction data can be read and the gradation correction can be performed prior to the actual printing.

The ink ribbon head portion may be a leader film of the ink ribbon. The correction data is obtained after the test printing by using the ink ribbon manufactured. The correction data thus obtained is recorded on the leader film and then the leader film is attached to the ink ribbon body portion, thereby simplifying the manufacturing process of the ink ribbon. According to need, the gradation correction data may be prepared, not for each manufactured lot, but for each product of the ink ribbon.

The gradation correction data may be recorded in a form of optically-readable marks, and hence the data can be read by a general optical sensor. Namely, it is not necessary to equip the thermal printer with a special sensor.

The leader film may include an aluminum deposited plastic film, and the mark may be a light absorbing or light diffusing mark recorded on the plastic film. Therefore, different gradation correction data can be recorded on the leader films in a unit of lots or respective products, and accurate correction data can be supplied to the user In addition, the marks can be read by a general optical sensor of reflection light detection type. On the contrary, the mark may be a light intercepting mark recorded on the plastic film. In that case, the marks can be read by a general optical sensor of transmitted light detection type.

The marks may include a plurality of sub-marks arranged in a form of a matrix including sub-mark lines positioned perpendicularly to a transfer direction of the ink ribbon. The sub-mark line represents a byte or a word which is a unit gradation correction data, and the sub-mark lines are arranged in alignment with each other in a the transfer direction. Therefore, the unit data, byte or word, can be read during the process of the ink ribbon transfer, and the byte or word can be arranged appropriately in accordance with the reading order thereof.

The gradation correction data may include a start position mark and an end position mark of the gradation correction data, and the start position mark and the end position mark include sub-mark lines in each of which all sub-marks have identical value. Therefore, the position of the marks can be readily recognized. Further, the sub-mark line may include a sub-mark for parity check bit. By this, the erroneous reading may be checked and correct reading is ensured. The sub-mark line may include a sub-mark indicating a reference timing of detecting the sub-marks. By this, the reading timing of the marks can be accurately controlled and the correct reading is ensured.

According to another aspect of the present invention, there is provided a thermal printer including: a detection unit for reading marks of gradation correction data recorded at a header portion of an ink ribbon and outputting a read-out signal; a reproduction unit for receiving the read-out signal and reproducing the gradation correction data; and a storage unit for storing the gradation correction data. In accordance with the thermal printer thus configured, the detection unit detects the gradation correction data, the reproduction unit reproduces the correction data, and the storage unit stores it. The gradation correction can be carried out by using the correction data thus stored. Since the gradation correction is applied to the original image data, not only the thermal printer but the external image processing unit may do the correction. Every time when the ink ribbon is exchanged, new correction data is stored in the thermal printer, and the stored data is retained there until new ink ribbon is set.

The thermal printer may further include: an operation unit for performing gradation correction of image data to be printed based on the gradation correction data; and a printing unit for printing the image data corrected by the operation unit. With this configuration, the thermal printer can perform the gradation correction and then do the printing.

According to still another aspect of the invention, there is provided an ink ribbon for use in a sublimation transfer type thermal printer, including: ink ribbon portions which is coated with color ink; and marks of manufacturing information recorded on the ink ribbon.

According to the ink ribbon, the manufacturing information is recorded on the ink ribbon and readable therefrom, and hence the gradation correction data corresponding to the ink ribbon can be identified based on the manufacturing information.

The marks may be recorded at a head portion of a group of the ink ribbon portions used for a single printing operation, and this enables easy reading of the manufacturing information prior to the use of group of the ink ribbon for printing. Further, the marks maybe recorded on a leader film of the ink ribbon. In this case, the manufacturing information is recorded on the leader film and then it is attached to the ink ribbon, thereby simplifying the manufacturing process of the ink ribbon.

The marks may be optically readable marks so that an optical sensor of general type can read the marks. The marks may be recorded by an ink jet printer. By this, the manufacturing information can be readily recorded. Compared with recording the information by using a print form plate, it is not necessary to produce new plates every time the products of different lot is manufactured. Further, the marks may be recorded by a fusion transfer type thermal printer to record the information with high quality, thereby improving the reliability in reading the marks.

The leader film may include an aluminum deposited plastic film, and the mark may be a light absorbing or light diffusing mark recorded on the plastic film. By this, the marks can be read by a general optical sensor of reflection light detection type. Contrary, the mark may be a light intercepting mark recorded on the plastic film so that a general optical sensor of transmitted light detection type can be used. Further, the mark may be a bar-code which is established technically, is readable accurately and requires low cost. The marks may be aligned in a transfer direction of the ink ribbon so that the manufacturing information can be readily read during the transfer of the ink ribbon. Further, the marks may include positioning marks specifying head portions of the ink ribbon portions, and the marks are recorded in alignment with the positioning marks in the transfer direction. With this structure, the marks of the manufacturing information and the positioning marks are readable by the same optical sensor.

According to still another aspect of the invention, there is provided a thermal printer including: a detection unit for reading manufacturing information recorded on an ink ribbon and outputting a read-out signal; a reproduction unit for receiving the read-out signal and reproducing the manufacturing information; and a storage unit for storing the manufacturing information. With this configuration, the detection unit detects the manufacturing information, the reproduction unit reproduces the information, and the storage unit stores it. The gradation correction can be carried out by using the correction data which is identified with the aid of the manufacturing information stored. Every time when the ink ribbon is exchanged, new correction data is stored in the thermal printer, and the stored data is retained there until new ink ribbon is set.

The thermal printer may further include: an operation unit for performing gradation correction of image data to be printed based on the manufacturing information; and a printing unit for printing the image data corrected by the operation unit. Further, the operation unit may include a database for storing a plurality of gradation correction data in association with manufacturing information; and a selecting unit for selecting the gradation correction data corresponding to the manufacturing information stored in the storage unit. With this configuration, the thermal printer can perform the gradation correction and then do the printing.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

Figure 1:
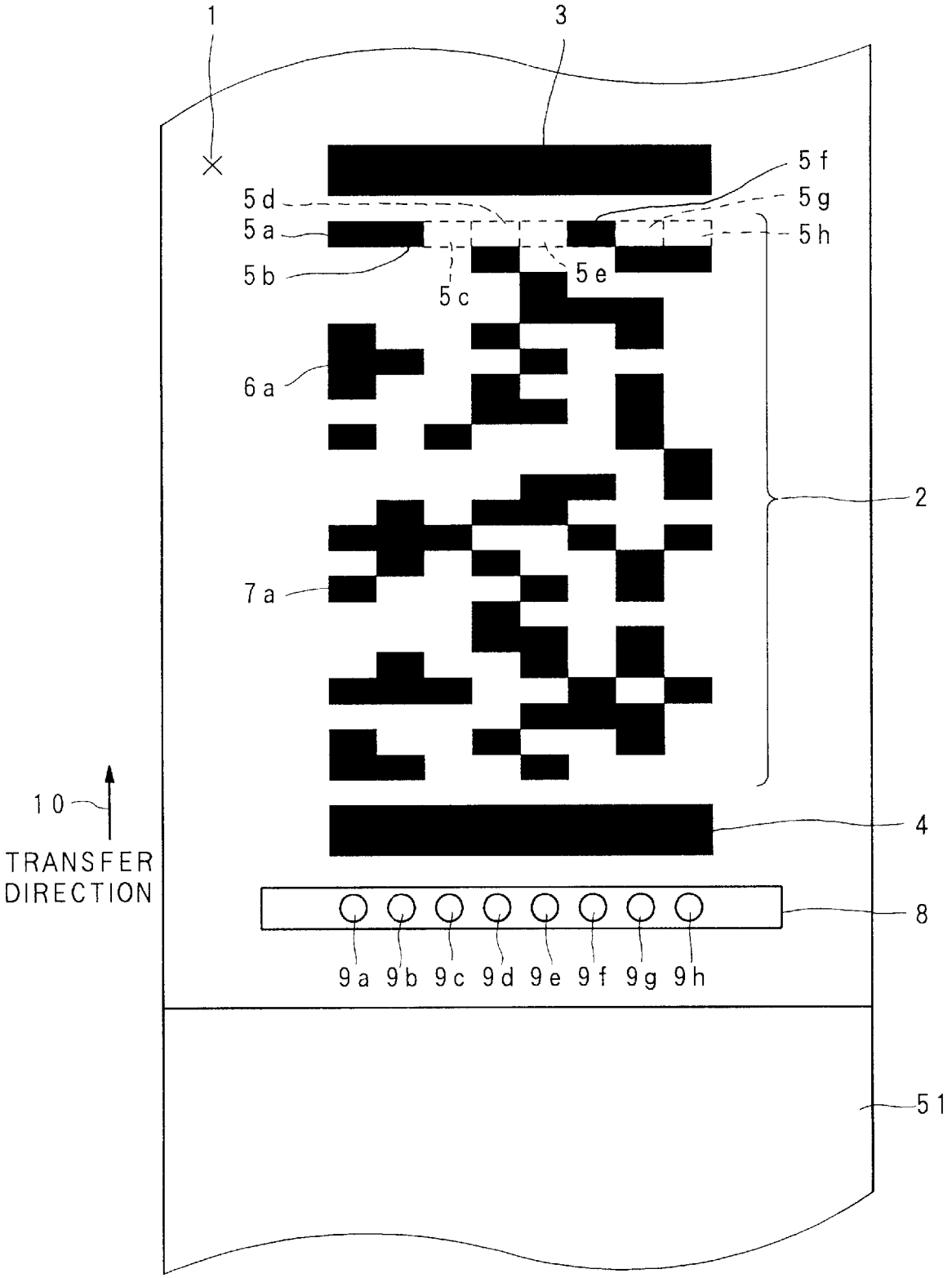
FIG. 1 is a diagram illustrating an example of the ink ribbon, according to the first embodiment, on which gradation correction data is recorded.

The preferred embodiments of the present invention will now be described below with reference to the attached drawings.

1st Embodiment

An ink ribbon used in a sublimation transfer type thermal printer is comprised of a film, functioning as a substrate, of some microns made of polyethylene terephthalate for example, the surface of which being coated with ink material by a photogravure coating device to form an ink layer. This ink layer contains sublimate ink which is sublimated by applying a heat through the film substrate by using a thermal head. The ink thus sublimated is transferred to an image-receiving sheet contacted to the ink layer, and then fixed on the sheet, thereby printing being achieved. In that case, the quantity of the ink thus sublimated can be controlled by varying the heat application power from the thermal head, and hence it is possible to represent smooth and natural gradation in the printing density.

The heating power of the thermal head and the print density have such a relationship that the higher the heating power is, the higher the printing density increase. However, if the heating power is equal, the absolute value of the print density may sometimes be different due to the characteristics of material and/or the composition of the ink ribbon. Also, even if the material and/or the composition of the ink ribbon is identical, the absolute values of the print density differ, even under the identical heating power, because all conditions such as the material lot and/or the manufacturing lot can not be perfectly uniform.

On the other hand, in the manufacturing process of the ink ribbon, the manufacturing condition is controlled so that a specific normal characteristic can be obtained. Specifically, at the initial stage of the manufacturing, the gradation scale is printed by the thermal printer, which is standardized for the test printing, with the use of the manufactured ink ribbon, then the printing density of the gradation scale thus printed is measured, and finally the manufacturing condition is reset in consideration of the result of the measurement. Resetting the manufacturing condition is mainly carried out by altering the viscosity and/or composition of the ink. Alternatively, the resetting may be performed by changing the condition of the coating device, for example, varying the angle of the doctor blade. However, since it is impossible to control the condition completely uniformly, irregularity in characteristics of the product is inevitable, even if it is within the specific allowable range.

For the above reason, in the present invention, data to be used for the gradation correction is calculated on the basis of the density measurement of the test printing and the manufactured ink ribbon is put on the market with the gradation correction data being recorded, thereby enabling the correction of the gradation for the purpose which requires especially high reproducibility of printing. The data for the gradation correction is calculated after the actual printing test for the respective manufacturing lots or more subdivided manufacturing units. The present invention is related to the ink ribbon including the data for the gradation correction and also to the thermal printer which uses the ink ribbon with the correction data.

Next, the ink ribbon with the data for gradation correction will be described below. FIG. 1 illustrates an example of gradation correction data. Specifically, FIG. 1 shows a leader film of an ink ribbon, on which gradation correction data is recorded in the form of optically-readable marks. The leader film 1 is transferred in the direction of the arrow 10 shown in FIG. 1. The gradation correction data may be recorded not on the leader film but on the head portion of the ink ribbon. In FIG. 1, there are shown a correction data area 2, a start position mark 3 of the marks, an end position mark 4 of the marks and sub-marks such as 5*a* to 5*h*, 6*a* and 7*a*. The sub-marks 5*a* to 5*h* make up a group of sub-marks aligned perpendicularly to the transfer direction 10, which will be hereinafter referred to as "a sub-mark line". It is noted that, in the following description, the "sub-mark" means not only the black rectangular shaped portion in FIG. 1 (black mark) where the printing is actually applied, but the blank rectangular shaped portion in FIG. 1 (blank mark) where no actual printing is applied. In FIG. 1, the blank marks are partly emphasized by the broken rectangles (5*c*, 5*d*, 5*e*, 5*g*, 5*h*). The rectangle 8 shows a detection unit of the thermal printer, and FIG. 1 shows the situation of the detection unit 8 after reading the correction data area 2. The detection unit 8 includes optical sensors 9*a* to 9*h* for optically reading the sub-marks, which are so arranged that each of the sensors are in an appropriate position to correspond to and read the respective sub-marks within a single sub-mark line. In the example of FIG. 1, the detection unit 8 is provided with eight optical sensors 9*a* to 9*h*.

As shown in FIG. 1, the start position mark 3 and the end position mark 4 are constituted by plural sub-mark lines in each of which all sub-marks represent identical bit value (i.e., black marks). Assuming that the portion of the black sub-mark represents "OFF" and the blank sub-mark represents "ON", the start position mark 3 in the case of FIG. 1 is the combination of two sub-mark lines representing "OFF" and following one sub-mark line representing "ON". Similarly, the end position mark 4 is the combination of one sub-mark line representing "ON" and following two sub-mark lines representing "OFF". When the start position mark 3 is read by the detection unit 8 during the leader film 1 being transferred in the direction 10, all optical sensors 9*a* to 9*h* output the successive detection signals "OFF", "OFF", "ON". When the end position mark 4 is read, all optical sensors output the detection signals "ON", "ON", "OFF". By detecting the combination of the detection signals, the start position mark 3 and the end position mark 4 are detected.

In the correction data area 2, data byte or data word, which is a basic unit of gradation correction data, is recorded in the form of the sub-mark lines each including the submarks, e.g., 5*a* to 5*h*. In the example of FIG. 1, the unit data includes 8 bits. The sub-marks, e.g., 5*a* to 5*h*, are recorded in correspondence with the bits, respectively. The sub-mark line including the sub-marks can be read simultaneously by the optical sensors 9*a* to 9*h* in the detection unit 8 of the thermal printer. The 8 bits of the sub-mark line include 7 data bits and 1 parity check bit. In FIG. 1, the sub-marks at the leftmost column, i.e., 5*a*, 6*a*, 7*a*, . . . correspond to the parity check bits. Out of the sub-marks in a single sub-mark line, e.g., 5*a* to 5*h*, 7 sub-marks other than the sub-mark 5*a*, i.e., 5*b* to 5*h*, are data bits. Out of them, sub-marks 5*c*, 5*d*, 5*e*, 5*g* and 5*h* represent "ON", and the sub-marks 5*b* and 5*f* represent "OFF". The sub-mark 5*a*, parity check bit, is determined and recorded such that the number of the bits in the ON-state (hereinafter simply referred to as "ON-bit") in the sub-mark line necessarily is odd number, in the example of FIG. 1. Therefore, in the sub-mark line including the sub-mark 5*a*, the parity check bit 5*a* represents "OFF". Similarly, in the sub-mark line beginning with the sub-mark 6*a*, the parity check bit is determined so that the total number of the ON-bits becomes odd number (5 in this case). In the other sub-mark lines, the parity check bit is determined and recorded in the same manner. Namely, the parity check bit is determined and recorded in the above manner for all sub-mark lines provided within the correction data area 2.

Figure 2:
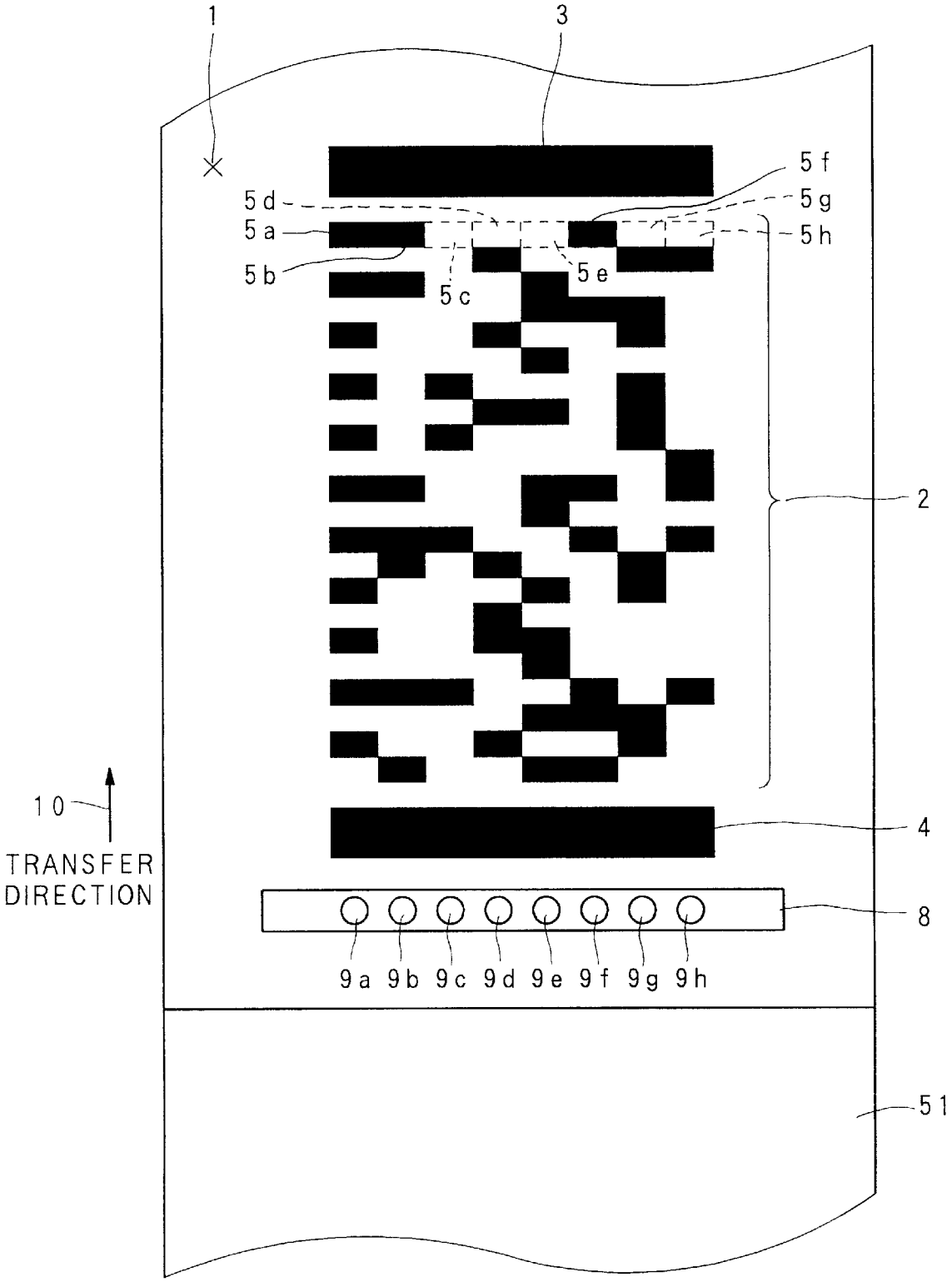
FIG. 2 is a diagram illustrating another example of the ink ribbon, according to the first embodiment, on which gradation correction data is recorded.

Next, another example of the gradation correction data will be described. FIG. 2 shows the example of gradation correction data, which is applied to the ink ribbon of the invention. In FIG. 2, the same portions as those shown in FIG. 1 are provided with the same reference numerals and the detailed description thereof will be omitted. The difference between the examples shown in FIGS. 1 and 2 will be described. In the sub-mark line in FIG. 1, the leftmost sub-mark in the sub-mark line represents the parity check bit. On the contrary, in the sub-mark line shown in FIG. 2, the leftmost sub-mark represents a detection timing bit with which the detection unit 8 controls the detection timings of the optical sensors. For this purpose, in the column of the leftmost sub-marks, the ON-bit sub-marks and OFF-bit sub-marks appear alternately in the transfer direction 10 of the leader film 1. The detection unit 8 reads the sub-marks of the detection timing bits, and picks up the value of the detection signals at the timing after a predetermined period from the rising-up (OFF to ON) or falling-down (ON to OFF) of the detection signal, thereby enabling the reading of the sub-marks at appropriate timings.

On the other hand, the sub-marks representing the parity check bits are recorded at the second positions from the left end of the sub-mark lines. In the similar manner as in FIG. 1, the parity check bit sub-marks are determined such that the total number of the ON-bits in the sub-mark line (including the detection timing sub-mark) necessarily becomes odd number.

In the case of FIG. 1, data bits are 7 bits, and in the case of FIG. 2 data bits are 6 bits. In the examples shown in FIGS. 1 and 2, data bit can be increased up to 8 bits because the detection unit 8 is provided with 8 optical sensors. The relationship between the data bit number and the numerical value expressed thereby is as follows:

| Total Bit Number | Without Sign Bit | With Sign Bit |
|---|---|---|
| 8 | 0–255 | −127→+127 |
| 7 | 0–127 | −63→+63 |
| 6 | 0–63 | −31→+31 |

Generally, in the case of printing image data by means of the thermal printer, large data having long data length read by the scanner is processed by the image data processor to express the gradation data by one byte. Namely, one byte is required in monochrome image. In additive color system, each of three primary colors (additive) R, G and B requires one byte, respectively, and hence three bytes are required in total. In subtractive color system, each of primary colors (subtractive) Y, M and C (or, Y, M, C, and K) requires one byte, respectively, and hence three or four bytes are required in total. Therefore, 6-bits correction data is sufficient to correct the 256 gradation steps expressed by each 1 byte data because correction between −31 to +31 may be achieved by 6 bit correction data.

It is not necessary to prepare the correction data for every gradation steps. Namely, in the case that correction data is prepared only for some representative gradation steps, other correction data to be used in the correction of other gradation steps may be obtained by a linear approximation technique. For example, in the system having 256 gradation steps (from 0 to 255), if correction data is prepared for 15th, 63rd, 127th, 191st and 255th gradation steps, correction data for other gradation steps may be interpolated by the linear approximation or other technique. In case that the correction data for five gradation steps are prepared for 4 colors, Y, M, C, and K, respectively, the total number of correction data is 20 (5 values×4 colors). In this case, if one correction data is represented by one byte as described above, total correction data may be constituted by 20 bytes data. By constituting correction data in this way, the number of the sub-mark lines in the correction data area 2 in FIGS. 1 and 2 may be 20, or a few more if some other data is included for designating an offset value for all gradation steps, etc.

Figure 3:
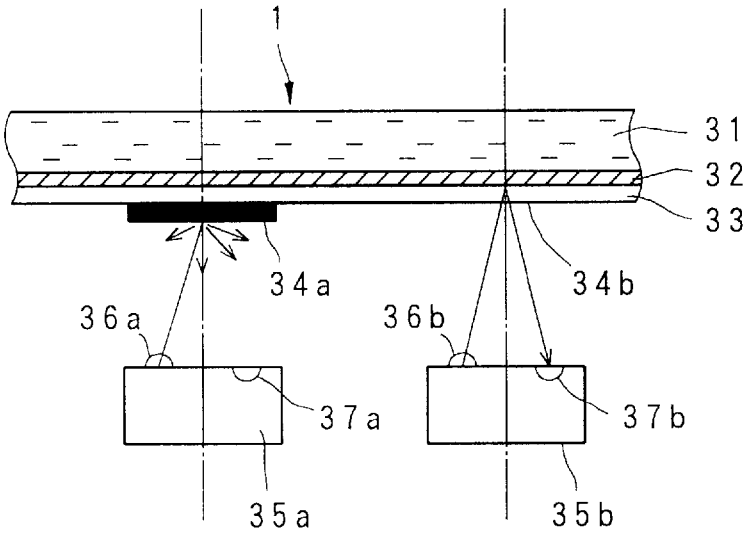
FIG. 3 is a diagram illustrating the configuration of a reflection light detection type optical sensor and a leader film used in the ink ribbon of the invention.

Next, the description will be given of the configuration of the head portion of the ink ribbon where gradation correction data is recorded and the detection operation of the sub-marks by the optical sensors 9*a* to 9*h*. FIG. 3 illustrates an example of the optical sensor employed in the detection unit 8 in the thermal printer and the leader film 1. As shown in FIG. 3, the leader film 1 is comprised of a substrate film 31 made of plastic film such as polyethylene terephthalate, an aluminum deposited layer 32 formed on the substrate film 31, and a transparent surface layer 33 for protecting the aluminum deposited layer 32 and enhancing adhesive property of the sub-marks. The black sub-mark 34*a* of gradation correction data and the blank sub-mark 34*b* of gradation correction data are formed on the surface layer 33. In FIG. 3, the reflection light detection type optical sensor 35*a* is detecting the black sub-marks 34*a*, and the reflection light detection type optical sensor 35*b* is detecting the blank sub-mark 35*b*. As seen, each of the optical sensors 35*a* and 35*b* include a light emission unit 36*a* or 37*a*, and a light reception unit 36*b* or 37*b*, integrally arranged on the sensors 34*a* or 34*b*. The light emitted by the optical sensor 35*a* and irradiated on the black mark 34*a* is absorbed and/or diffused by the black sub-mark 34*a*, and hence the light reception unit 37*a* receives relatively small quantity of reflected light. In contrast, the light emitted by the optical sensor 35*b* and irradiated on the black sub-mark 34*b* passes through the transparent surface layer 33 to be reflected (almost totally) by the aluminum deposited layer 32, and then passes again through the surface layer 33 to reach the light reception unit 37*b*. Therefore, the light quantity received by the light reception unit 37*b* is large. Based on the difference of the received light quantities, the optical sensors 35*a* and 35*b* output the detection signal indicative of the presence or absence of the black sub-mark.

Figure 4:
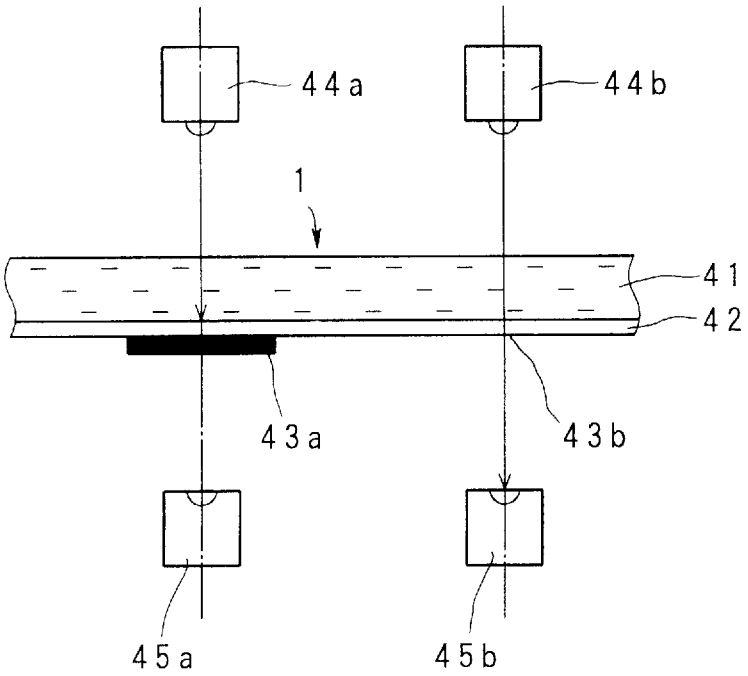
FIG. 4 is a diagram illustrating the configuration of a transmitted light detection type optical sensor and a leader film used in the ink ribbon of the invention.

FIG. 4 illustrates an example of a transmitted light detection type optical sensor and the leader film 1 provided at the head portion of the ink ribbon of the invention. As shown in FIG. 4, the leader film is comprised of a transparent substrate film 41 made of plastic film such as polyethylene terephthalate, and a transparent surface layer 42 for enhancing adhesive property of the marks. The black sub-mark 43*a* and the blank sub-mark 43*b* are formed on the surface layer 42 as gradation correction data. FIG. 4 further shows a light emission unit 44*a* and a light reception unit 45*a* of the transmitted light detection type optical sensor which is detecting the black sub-mark 43*a*, and a light emission unit 44*b* and a light reception unit 45*b* of the transmitted light detection type optical sensor which is detecting the blank sub-mark 43*b*. As illustrated, the light beam emitted by the light emission unit 44*a* and passed through the transparent substrate film 41 and the surface layer 42 to reach the black sub-mark 43*a* is interrupted by the black sub-mark 43*a*, and hence the light quantity received by the light reception unit 45*a* is small. In contrast, the light beam emitted by the light emission unit 44*b* and passed through the transparent substrate film 41 and the surface layer 42 to reach the black sub-mark 43*b* is not interrupted by the blank sub-mark 43*b*, and hence the light quantity received by the light reception unit 45*b* is large. Based on the difference of the received light quantities, the optical sensors output the detection signal indicative of the presence or absence of the black sub-mark.

The sub-marks serving as gradation correction data, shown in FIGS. 3 and 4, may be recorded on the leader film 1 by means of a fusion or melting transfer type thermal printer. The gradation correction data is obtained in the following manner. First, by using the ink ribbon manufactured, a gradation scale is printed by a sublimation transfer type thermal printer which is standardized for the test purpose. Then, the print density of the gradation scale thus printed is measured to generate gradation correction data. The gradation scale is a scale representing discrete print density values for the gradation steps determined between the values 0 to 255, for example. It is ruled that predetermined gradation steps in the gradation scale should take predetermined print density values (within a print density range). Therefore, in order to correct the irregular print density values thus measured to be the regular value within the ruled range, the regular print density value of the gradation step is calculated from the gradation scale, and then the difference between the calculated value and the regular appropriate value is calculated, thereby producing the gradation correction data. The gradation correction data thus obtained take different values dependently upon the lot of the ink ribbons and other specific factors, and hence the difference of the print density due to the lot difference or the specific factors is corrected by recording the gradation correction data on the leader film 1.

Figure 5:
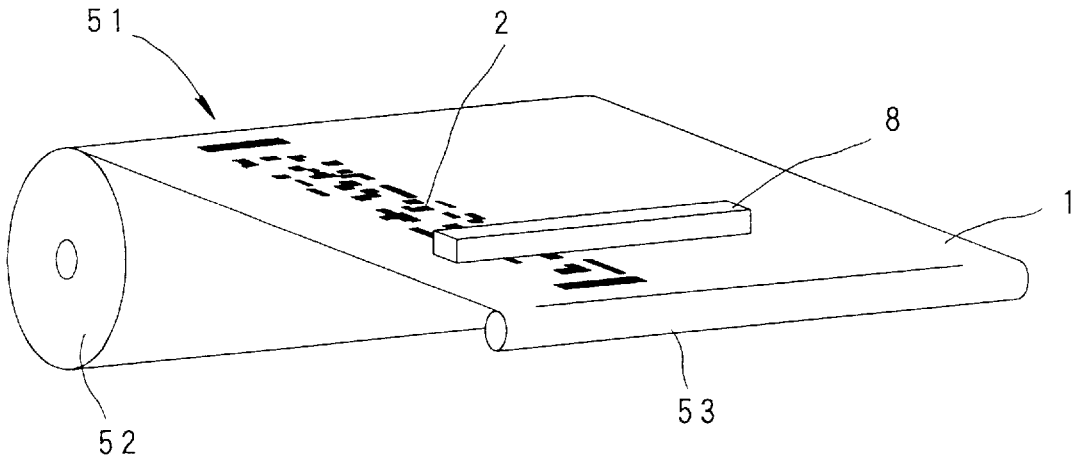
FIG. 5 is a diagram illustrating the arrangement of the ink ribbon set in the thermal printer and the detection unit according to the first embodiment.

FIG. 5 illustrates the arrangement of the ink ribbon 51 and the detection unit 8 in the condition being set within the thermal printer. In FIG. 5, there are shown an ink ribbon 51, a supply roll 52 on the ribbon supplying side, a take-up roll 53 on the ribbon take-up side, the correction data area 2 and the detection unit 8 of the thermal printer. As shown in FIG. 5, the ink ribbon 51 is a roll of a long sheet (long film), and the ink sheet released from the supply roll 52 is taken up by the take-up roll 53. Between the supply roll 52 and the take-up roll 53, the detection unit 8 of the thermal printer reads the sub-marks recorded on the correction data area 2. Based on the gradation correction data thus read, the arithmetic operation is carried our to correct the gradations of the image data to be printed, and the thermal head (not shown) of the thermal printer prints the image data thus corrected at the position between the supply roll 51 and the take-up roll 53. In FIG. 5, the cassette case of the ink ribbon is omitted from the illustration. There are known ink ribbons which are housed in the cassette cases and are not housed. The type of the ink ribbon does not put the limit to application of the present invention, and the ink ribbons of both types may be used.

Figure 6:
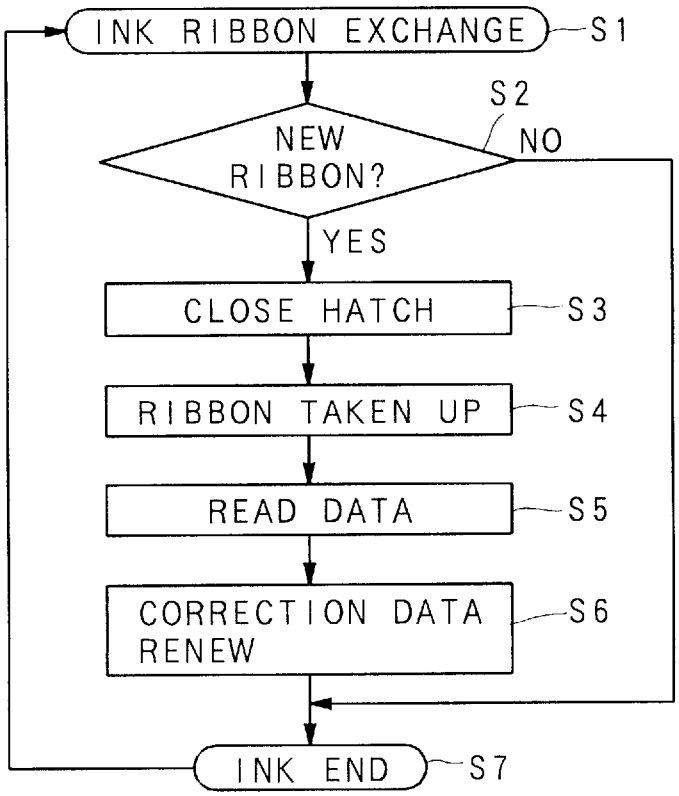
FIG. 6 is a flowchart illustrating the gradation correction data reading process by the thermal printer, according to the first embodiment.

Next, the operation of the thermal printer according to the present invention will be described below. FIG. 6 is a flowchart illustrating the reading process of the gradation correction data by the thermal printer. The gradation correction data is read out every time when the ink ribbon is exchanged. The gradation correction data is read out immediately after the exchange of the ink ribbon, and then the gradation correction data thus read out is stored in the storage unit within the thermal printer. The data thus stored is retained therein until it is renewed at the time of next ink ribbon exchange.

First, the exchange of the ink ribbon is started and an ink ribbon is set in the ink ribbon housing portion of the thermal printer in step S1. If the ink ribbon is of cassette-housed type, it is simply attached to the housing portion. If the ink ribbon is not of cassette-housed type, the roll of the ink ribbon is set to the roll holder in the ink ribbon housing portion, and the leader portion of the ink ribbon is taken out therefrom to lap around the take-up roll 53. Next, it is judged in step S2 whether or not the ribbon is new one. It is common that an ink ribbon, once used, is again set in the thermal printer for repeated use in both ink ribbons of cassette-housed type and non-housed type. Especially in the case of cassette-housed type, such repeated use is frequently done. In addition, the open-close hatch of the ink ribbon housing portion may sometimes be opened for maintenance. In the case of the used ink ribbon, the correction data area 2, i.e., the lead film portion of the ribbon, has been taken up by the take-up roll 53 and is not readable. Therefore, it is judged whether the ink ribbon is new or not in step S2, and if it is new one, the operator manipulates the reading mode switch of the correction data to be "ON". If the reading mode switch is activated, the correction data is read out in the steps after step S3 described later. If the ribbon is not new, the operator does not manipulate the reading mode switch. In that case, the correction data reading mode switch remains "OFF" state and the gradation correction data at that time remains valid after that. Alternatively, the operator may set the appropriate gradation correction data again based on the manufacturing lot number of the ink ribbon or the like. If the ink ribbon set is not new, the gradation correction data reading process, steps S3 to S6, are skipped.

Subsequently, the operator closes the open-close hatch of the ink ribbon housing portion in step S3. When the hatch is closed, the thermal printer starts the reading routine of the gradation correction data automatically and performs necessary operations. Then, the ink ribbon 51 is released from the supply roll 52 and taken up by the take-up roll 53 in step S4. In step S5, when the correction data area 2 on the lead film portion 1 of the ink ribbon 51 reaches the position under the detection unit 8 of the thermal printer, the detection unit 8 reads the start position mark 3 first, then the correction data area 2 and finally the end position mark 4. The successive detection signal of the marks thus read is supplied by the detection unit 8 to the data processing unit of the thermal printer (including a CPU, a storage unit and other associated units in the thermal printer), and is stored in the temporary storage unit such as a register.

Next, in step S6, the data stored in the temporary storage unit is transferred to the storage unit of the thermal printer as it is or after the data format conversion by the data processing unit. The conversion of the data format is such as to calculate correction data for all gradation steps and produce a conversion table in the case, for example, that the correction data includes correction values for only the representative gradation steps and the correction data for other gradation steps should be calculated by the linear approximation technique or the like. The data stored in the storage unit is retained therein, and when the ink ribbon ends after repeated printing operations (step S7), the process returns to step S1 to repeat the above described steps, thereby the data stored in the storage unit being renewed.

Figure 7:
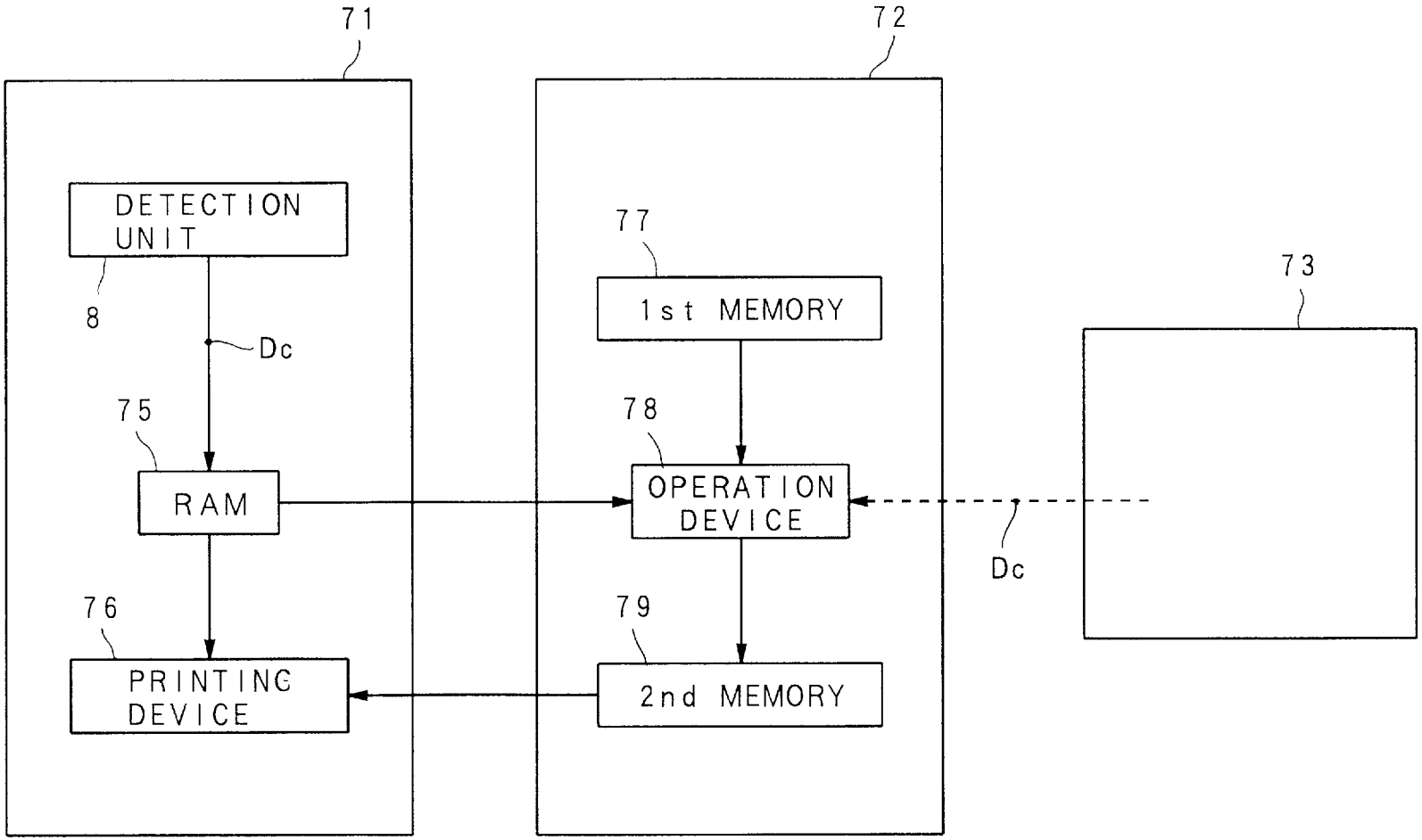
FIG. 7 is a block diagram illustrating the configuration of the thermal printer according to the first embodiment.

FIG. 7 illustrates a configuration of an example of the thermal printer system according to the present invention. As shown, the thermal printer system includes a thermal printer 71, and a host computer 72 which generates the corrected image data from the original image data and the correction data and supplies it to the thermal printer 71. In this example, the thermal printer 71 functions as a terminal device of the host computer 72. The printer system further includes an input device 73 which also functions as a terminal device of the host computer 72. Specifically, the thermal printer 71 includes the detection unit 8 of the gradation correction data marks recorded on the leader film 1, a RAM (Random Access Memory) 75 which is a storage device for storing the gradation correction data, and a printing device 76 for receiving the image data, performing necessary data processing to reproduce the image and printing the image. The RAM 75 is provided with a battery backup function for retaining the correction data until the ink ribbon ends. The thermal printer 71 includes a data processor for converting the RGB data of three primary colors into printing data of colors Y, M, C and K data, a printing mechanism having a thermal head and other necessary components like the conventional thermal printer. Alternatively, the host computer 72 may take the burden of the data conversion from the RGB data to the YMCK printing color data, and in that case, of course, the data processing unit may be eliminated from the printer device 71.

The host computer 72 includes a first memory 77 for storing the original image data which is inputted by a scanner or the like, an operation device 78 for performing gradation correction, and a second memory 79 for storing the image data after the gradation correction. The input device 73 includes a display, a keyboard, a mouse and other associated devices, and is so designed that the operator can input the correction data with his hands by referring to the correction data list attached to the ink ribbon.

Next, the operation will be described. When a new ink ribbon is set to the thermal printer 71, the detection unit 8 reads the sub-marks of gradation correction data to obtain the correction data, which is stored in the RAM 75. The host computer 72 reads out the correction data from the RAM 75, and the operation device 78 carries out the correction operation of the original image data stored in the first memory 77. If the correction data is of such type that the correction values are prepared only for some representative gradation steps and correction values for other gradation steps should be calculated by the linear approximation, the operation device 78 produces the conversion table and then performs the correction of the original image data by referring to the table thus produced. On the other hand, if the correction data stored in the RAM 75 is the conversion table itself, the operation device 78 performs the correction by referring to the table stored in the RAM 75. As a result of the correction by the operation device 78, the corrected image data is produced and stored in the second memory 79. Subsequently, the printing device 76 in the thermal printer 71 receives the corrected image data and performs printing.

Next, the conversion of the color image data will be described. The image data is a set of values of picture elements (pixels) and the value of the color picture element is a vector value which consists of three scholar values of R, G and B in the case of three primary color additive system, for example. In that case, the conversion table is constituted by three sub-tables for the three primary colors, R, G, and B. The sub-tables are referred to for each color component (R, G, B) of a picture element to obtain a picture element value (Rc, Gc, Bc) after the conversion. Also in this case, the printing device 76 requires the provision of a data processing unit which converts the RGB image data into YMCK color data. On the other hand, the color pixel value may be constituted by scholar values of four printing colors, Y, M, C, and K. In that case, the conversion table needs to include four sub-tables of Y, M, C, and K, and the respective sub-tables are referred to with respect to the pixel value (Y, M, C, K), so as to obtain converted pixel value (Yc, Mc, Cc, Kc). In this case, the printing device 76 does not need the data processing unit for the conversion of RGB data into YMCK data.

Figures 8, 9:
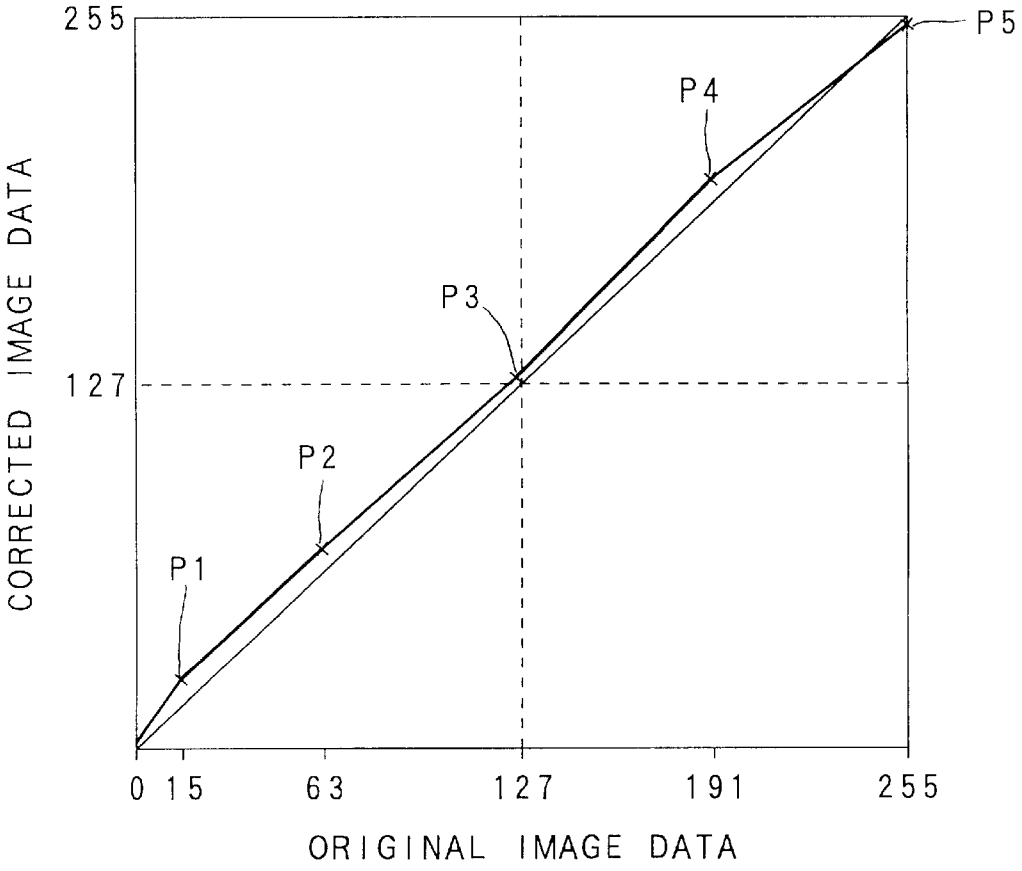
FIG. 8 is a table illustrating an example of the gradation correction data.
FIG. 9 is a graph illustrating the relationship between an original image data and a corrected image data, i.e., an example of the contents of a conversion table.

Next, the examples of the correction data and the conversion table will be described below. FIG. 8 shows an example of the correction data in the form of table. As seen, the correction data of this example includes five correction values corresponding to the five gradation steps, 15th, 63rd, 127th, 191st, and 255th, for each of the four printing colors Y, M, C, and K. Further, an offset value to be applied to all gradation steps is given. FIG. 9 illustrates an example of the relationship between the original image data and the corrected image data, i.e., the contents of the conversion table in the form of graph. The conversion table shown in FIG. 9 is produced from the correction data of the printing color Y shown in FIG. 8.

As seen in FIG. 8, the correction value of the printing color Y at the 15th gradation step is "+5",. This means that, if the value of the printing color Y of the original image data is "15", it should be corrected to be "20" by making "+5" correction. Further, since the offset value valid for all gradation steps is "+2", "+7" correction should be made to the original value "15" of the printing color Y, thereby the corrected value of the color Y being "22". In FIG. 9, the point P1 corresponds to the above correction data, and the coordinate of P1 is: (original image data, corrected image data)=(15, 22). In FIG. 8, the correction value of the 63rd gradation step in the printing color Y is "+3", and this means that the original value "63" of printing color Y in the original image data should be corrected by making "+3" to be "66". Further, since the offset value valid for all gradation steps is "+2", "+5" correction should be made to the original value "63" of the original printing color Y, thereby the corrected value of the color Y being "68". In FIG. 9, the point P2 corresponds the above correction data, and the coordinate of P2 is: (original image data, corrected image data)=(63, 68). Similarly, the point P3 corresponds to the 127th gradation step of the original image data where the correction data is "0" and the offset value is "+2", and hence the coordinate of the point P3 is: (original image data, corrected image data)=(127, 129). Similarly, the point P4 corresponds to the 191st gradation step of the original image data where the correction data is "+1" and the offset value is "+2", and hence the coordinate of the point P4 is: (original image data, corrected image data)=(191, 194). Similarly, the point P5 corresponds to the 255th gradation step of the original image data where the correction data is "−5" and the offset value is "+2", and hence the coordinate of the point P5 is: (original image data, corrected image data)=(255, 252).

The conversion table of the printing color shown in FIG. 9 is obtained by connecting the points P1 to P5 whose coordinate positions are thus set. The conversion table (sub-table) of the printing color Y is equivalent to the graph shown in FIG. 9, and is composed of the table which describes the graph as the reference table. The sub-tables are prepared for all other printing colors, M, C, and K in the same manner. By producing four sub-tables in this way, the complete conversion tables for the printing colors may be produced. Although the above description is directed to the conversion table of the printing colors Y, M, C and K, the conversion table for three primary colors R, G and B may be produced in the same way, and therefore the detailed description thereof will be omitted.

2nd Embodiment

Figure 10:
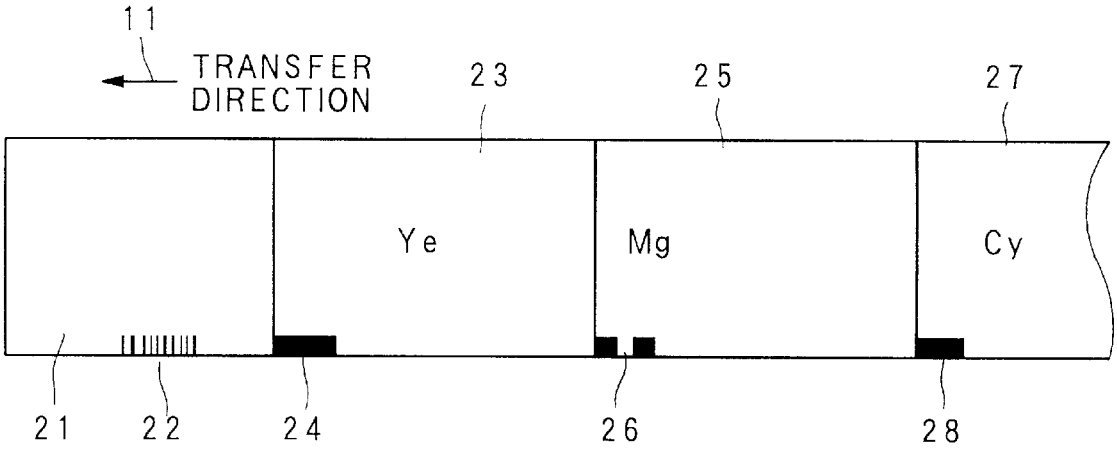
FIG. 10 is a diagram illustrating an example of the ink ribbon, according to the second embodiment, on which manufacturing information is recorded.

Next, a second embodiment of the present invention will be described below. FIG. 10 shows an ink ribbon on which manufacturing information is recorded. In FIG. 10, the leader film 21 of the ink ribbon is recorded with manufacturing information, in a form of optically readable marks (bar-code). The leader film 21 is transferred in the direction indicated by the arrow 11, and the body of the ink ribbon is transferred in the same direction to follow the leader film 21. Within the leader film 21, the bar-code 22, which is the mark of the manufacturing information, is recorded. The leader film 21 is provided at the head portion of the ink ribbon, and hence the leader film 21 is followed by the ink ribbon which includes an yellow ink area 23, a Magenta ink area 25 and a Cyan ink area 27. The start position mark 24 is provided at the head portion of the yellow ink area 23, and the start position mark 26 is provided at the head portion of the Magenta ink area 25. Similarly, the start position mark 28 is provided at the head portion of the Cyan ink area 27. The start position marks 23, 25 and 27 indicate the head of the ink areas of the respective colors. As the manufacturing information, recorded in the form of bar-code 22, successive manufacturing numbers applied to the same products, lot numbers and the like may be used. By referring to the manufacturing information, the gradation correction data to be used at the time of printing with the ink ribbon is identified. Namely, the manufacturing information such as the manufacturing number, the lot number or the like has the one-to-one correspondence with the correction data of the ink ribbon. A certain common correction data may be used for some of the ink ribbons applied with different manufacturing numbers or the lot numbers. As shown in FIG. 10, the bar-code 22 is recorded near the edge portion of the leader film 21, and is detected by scanning it while the leader film 21 is transferred in the direction 11. Namely, the bar-code 22 is read by the work of the ink ribbon transfer mechanism and the sensor provided in the thermal printer. Also, as seen in FIG. 10, the start position marks 24, 26 and 28 are recorded near the edge portions of the ink areas 23, 25 and 27, respectively. The bar-code 22 is recorded on the same linear line, directed to the ink ribbon transfer direction 11, as the start position marks 24, 26 and 28. As a result, the bar-code 22 and the start position marks 24, 26 and 28 may be detected by the same sensor. The sensor may be an optical sensor.

Figure 11:
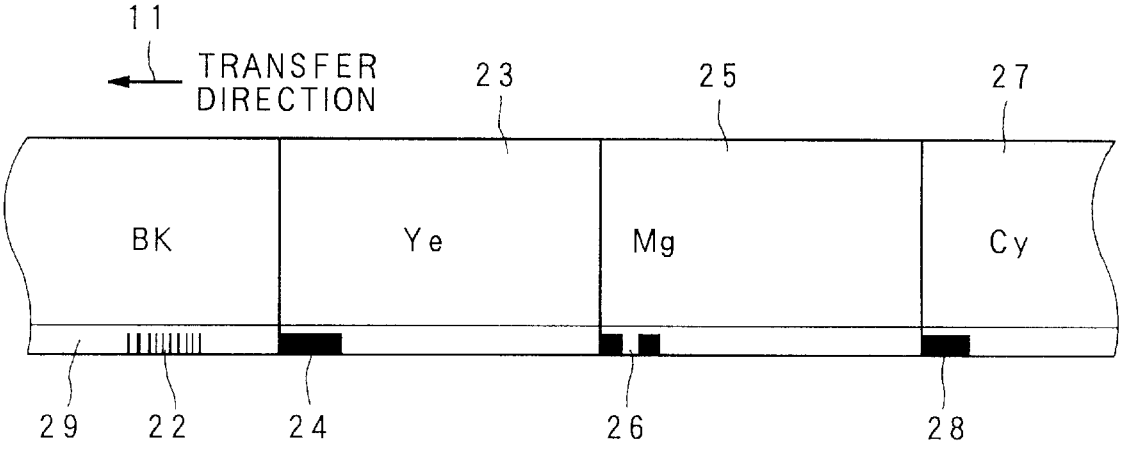
FIG. 11 is a diagram illustrating another example of the ink ribbon, according to the second embodiment, on which manufacturing information is recorded.

FIG. 11 shows an modification of the ink ribbon shown in FIG. 10. In FIG. 11, the portions identical to those in FIG. 10 are applied with the same reference numerals and the description thereof will be omitted. In FIG. 11, a black ink area 29 is formed after the Magenta ink area 25, and the bar-code 22 is recorded within the black ink area 29 near the edge portion thereof. In the case of color printing, the printing inks of four colors (Y, M, C, K) are used as described, and the print densities of each color is controlled to create a desired color. The ink areas of the four colors are arranged in the printing order, and the a group of the four ink areas, i.e., from the yellow ink area 23 to the black ink area 29, is used for one printing. In the example of FIG. 11, the printing order of the four colors is Yellow, Magenta, Cyan, Black.

As seen in FIG. 11, the bar-code 22 is recorded within the black ink area 29 near its end portion (i.e., very close to the head or beginning portion of the following yellow ink area 23). In other words, the position of the bar-code 22 is substantially at the head portion of the subsequent group of four-color ink areas 23, 25, 27 and 29. By recording the bar-code 22 carrying the manufacturing information related to the ink ribbon itself at this portion thereof, the manufacturing information is read just before the start of the printing using next four ink areas. Therefore, even if the used ink ribbon (which has been taken up for some length by the previous usage) is again used, the manufacturing information may be readily read. Namely, it is not necessary to rewind the used ink ribbon back to the head portion thereof.

Figure 12:
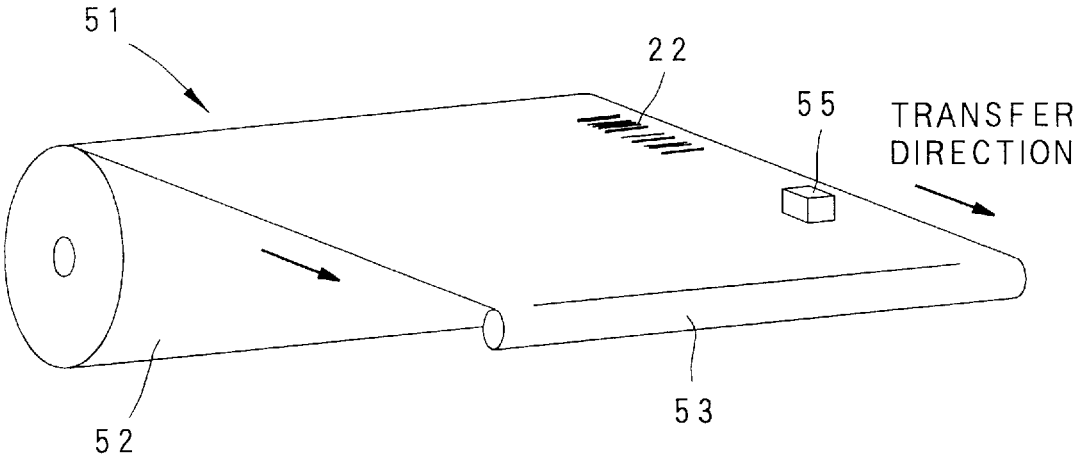
FIG. 12 is a diagram illustrating the arrangement of the ink ribbon set in the thermal printer and the detection unit according to the second embodiment.

The bar-code 22 carrying the manufacturing information is detected by the optical sensors in the similar manner as the first embodiment, namely, by using the optical sensor of the reflected light detection type or the transmitted light detection type shown in FIGS. 3 and 4. In the second embodiment, the detection unit 55 for reading the bar-code 22 is arranged in the manner shown in FIG. 12. Likewise, the presence and the absence of the bars in the bar-code 22 is detected based on the light quantity of the reflected or transmitted light. Not only the bar-code 22 but also the start position marks 24, 26 and 28 are detected by the same optical sensor of the detection unit 55 shown in FIG. 12.

The bar-code 22 carrying the manufacturing information may be recorded on the leader film or at the appropriate portion within the ink areas by means of a fusion transfer type thermal printer or an ink jet printer.

In the first embodiment, the gradation correction data is recorded on the leader film 1 of the ink ribbon to enable the gradation correction of the image to be printed. In the second embodiment, the manufacturing information is recorded on the leader film 21 and/or the black ink area 29 as shown in FIGS. 10 or 11, and the gradation correction data for the ink ribbon is identified by using the manufacturing information. The gradation correction data for the ink ribbons are calculated in the same manner as the first embodiment, and are stored beforehand in the thermal printer with the manufacturing information. With the aid of the manufacturing information, the correction data prepared for the particular ink ribbon can be correctly identified.

The reading process of the manufacturing information will be described below with reference to FIG. 13. In the case that the manufacturing information is recorded only on the leader film 21, like FIG. 10, the reading process of the manufacturing information is carried out every time when the ink ribbon is exchanged. Immediately after the ink ribbon exchange, the manufacturing information is read and is stored in the storage unit within the thermal printer. The manufacturing information thus stored is retained until it is renewed at the time of the next ink ribbon exchange. On the other hand, in the case that the manufacturing information is recorded before every group of four-ink areas, i.e., on every black ink area 29 as shown in FIG. 11, the manufacturing information is read prior to the every printing operation, and the read information is stored in the storage unit in the thermal printer.

Figure 13:
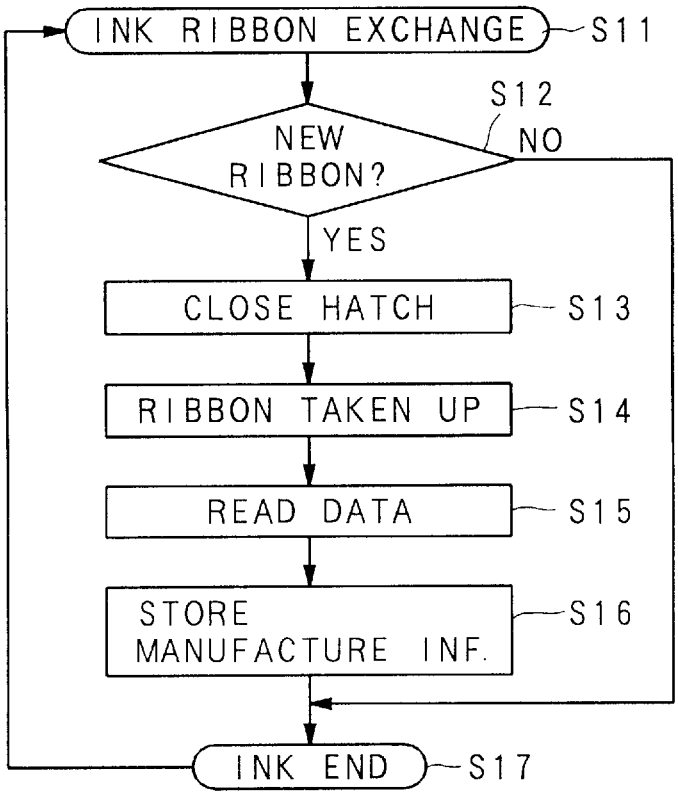
FIG. 13 is a flowchart illustrating the gradation correction data reading process by the thermal printer, according to the second embodiment.

Referring to FIG. 13, first, the exchange of the ink ribbon is started and an ink ribbon is set in the ink ribbon housing portion of the thermal printer in step S11. This is performed in the same manner as the first embodiment, i.e., step S1 in FIG. 6. Next, it is judged in step S12 whether or not the ribbon is new one. In the case of used ink ribbon, the leader film 21 has taken up by the take-up roll 53 and is not readable. Therefore, it is judged whether the ink ribbon is new or not in step S12, and if it is new one, the operator manipulates the reading mode switch of the manufacturing information to be "ON". However, even if it is not new, the reading switch is made "ON" state in the case of the ink ribbon in which the manufacturing information is recorded on the body of the ribbon like the ink ribbon shown in FIG. 11. If the reading mode switch is activated, the manufacturing information is read out in the steps after step S13 described later. If the ribbon is not new and the manufacturing information is recorded only on the leader film 21 (i.e., ink ribbon in FIG. 10), the operator does not manipulate the reading mode switch of the manufacturing information. In that case, the manufacturing information reading mode switch remains "OFF" state and the manufacturing information at that time remains valid after that. Alternatively, the operator may set the appropriate manufacturing information again based on the manufacturing lot number of the ink ribbon or the like. If the ink ribbon set is not new and the manufacturing information is recorded only on the leader film 21, the manufacturing information reading process, i.e., steps S13 to S16, are skipped.

Subsequently, the operator closes the open-close hatch of the ink ribbon housing portion in the thermal printer in step S13. When it is closed, the thermal printer starts the reading out routine of the manufacturing information automatically and performs necessary operations. Then, the ink ribbon is released from the supply roll 52 and taken up by the take-up roll 53 in step S14. In step S15, when the bar-code 22 carrying the manufacturing information reaches the position under the detection unit 55 of the thermal printer, the detection unit 55 reads the bar-code 22. The detection signal of the bar-code 22 thus read is supplied by the detection unit 55 to the data processing unit of the thermal printer, and is stored in the temporary storage unit such as a register. Next, in step S16, the data stored in the temporary storage unit is transferred to the storage unit of the thermal printer as it is or after the data format conversion by the data processing unit. The data thus stored in the storage unit is retained therein, and when the ink ribbon ends after printing operations (step S17), the process returns to step S11 to repeat the above described steps and the data stored in the storage unit is renewed.

Figure 14:
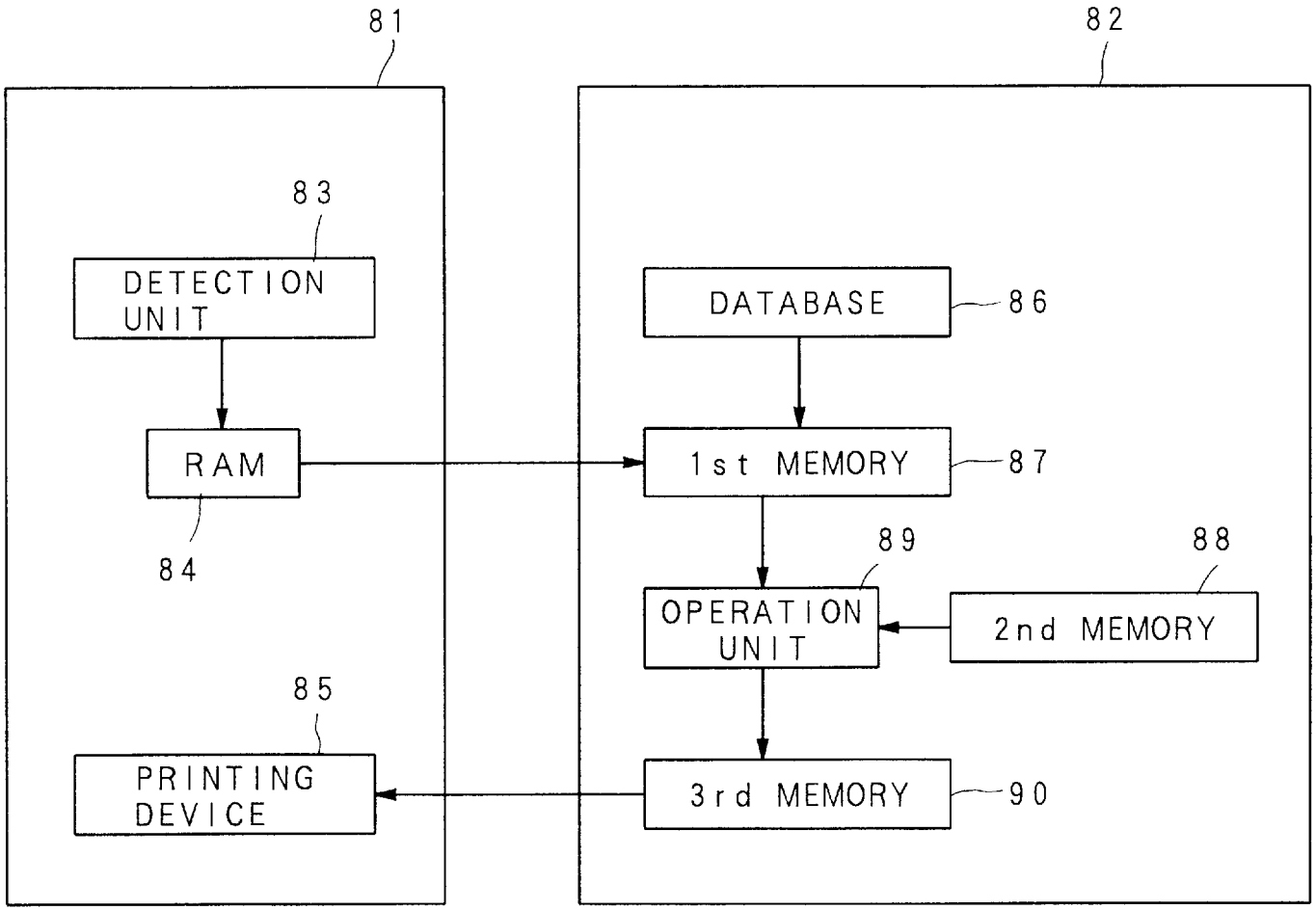
FIG. 14 is a block diagram illustrating the configuration of the thermal printer according to the second embodiment.

FIG. 14 illustrates a configuration of an example of the thermal printer system according to the second embodiment. As shown, the thermal printer system includes a thermal printer 81, and a host computer 82 for generating corrected image data from the original image data and the correction data and for supplying it to the thermal printer 81. In this example, the thermal printer 81 functions as a terminal device of the host computer 82. The thermal printer 81 includes a detection unit 83, such as a bar-code reader, for detecting the bar-code 22 carrying the manufacturing information recorded on the ink ribbon, a RAM (Random Access Memory) 84 which is a temporary storage device for storing the manufacturing information (such as a lot number or the like), and a printing device 85 for receiving the image data, performing necessary data processing to reproduce the image and printing the image. The RAM 84 is provided with a battery backup function for retaining the correction data until the ink ribbon ends. The thermal printer 81 includes a data processor for converting the RGB data of three primary colors into printing data of colors Y, M, C and K data, printing mechanism having a thermal head and other necessary components like the conventional thermal printer. Alternatively, the host computer 82 may take the burden of the data conversion from RGB data to YMCK printing color data, and in that case, of course, the data processing unit may be eliminated from the thermal printer 81.

The host computer 82 includes a database 86 for storing gradation correction data for ink ribbons in association with the manufacturing information, a first memory 87 for temporarily storing the correction data which corresponds to the ink ribbon currently in use, a second memory 88 for storing the original image data which is inputted by a scanner or the like, an operation device 89 for performing gradation correction, and a third memory 90 for storing the image data after the gradation correction.

Next, the operation will be described. When the new ink ribbon is set to the thermal printer 81, the detection unit 83 reads the bar-code 22 to obtain the manufacturing information, which is stored in the RAM 84. On the other hand, the host computer 82 has copied the gradation correction data corresponding to a plurality of manufacturing information, in advance, to produce the database 86 of the correction data which stores various gradation correction data. The plural correction data may be recorded on a floppy disc or the like attached to the ink ribbon. The host computer 82 reads the manufacturing information stored in the RAM 84, and selects the correction data corresponding to the manufacturing information from the database 86. The correction data thus selected is temporarily stored in the first memory 87. The operation device 89 carries out the correction of the original image data in the second memory 88 by using the correction data stored in the first memory 87. The structure or the contents of the gradation correction data is identical to that of the first embodiment, and hence the detailed description will be omitted. After the gradation correction, the operation unit 89 outputs the corrected image data which is temporarily stored in the third memory 90 and is then supplied to the printing device 85. The printing device 85 performs the printing of the corrected image data. In this way, the printing of the image data is performed.

What is claimed is:

1. An ink ribbon for use in a sublimation transfer type thermal printer, comprising:

an ink ribbon body portion which is coated with color ink; and an ink ribbon head portion on which gradation correction data is recorded, said gradation correction data being recorded in a form of a matrix of discontinuous markings comprising a plurality of columns arranged in a transfer direction of the ink ribbon, said plurality of columns comprising a plurality of columns of gradation correction data sub-marks and a column-of parity sub-marks for a parity check of the sub-marks in rows of the matrix.

2. An ink ribbon according to claim 1, wherein said ink ribbon head portion comprises a leader film of said ink ribbon.

3. An ink ribbon according to claim 2, wherein said gradation correction data comprises a start position mark and an end position mark of said gradation correction data, said start position mark and said end position mark comprising sub-mark lines in each of which all sub-marks have identical value.

4. An ink ribbon according to claim 2, wherein said sub-mark comprises a sub-mark for parity check bit.

5. An ink ribbon according to claim 2, wherein said sub-mark line comprises a sub-mark indicating a reference timing of detecting the sub-marks.

6. An ink ribbon according to claim 1, wherein said leader film comprises an aluminum deposited plastic film, and said mark comprises a light absorbing or light diffusing mark recorded on said plastic film recorded by a fusion transfer type thermal printer.

7. An ink ribbon according to claim 1, wherein said leader film comprises an aluminum deposited plastic film, and said mark comprises a light intercepting mark recorded on said plastic film by a fusion transfer type thermal printer.

8. An ink ribbon according to claim 1, wherein said parity sub-marks are determined such that, for all rows, a total number of the sub-marks in the row is one of odd number and even number.

9. A thermal printer for use with an ink ribbon comprising an ink ribbon head portion on which gradation correction data is recorded in a form of a matrix of discontinuous markings a plurality of columns arranged in a transfer direction of the ink ribbon, said plurality of columns comprising a plurality of columns of gradation correction data sub-marks and a column of parity sub-marks for a parity check of the sub-marks in rows the matrix, said printer comprising:

a detection unit for reading the gradation correction data sub-marks during the transfer movement of the ink ribbon and outputting a read-out signal;

a reproduction unit for receiving the read-out signal and reproducing the gradation correction data; and a storage unit for storing the gradation correction data.

10. A thermal printer according to claim 9, further comprising:

an operation unit for performing gradation correction of image data to be printed based on the gradation correction data; and a printing unit for printing the image data corrected by said operation unit.

11. A thermal printer according to claim 9, wherein said detection unit comprises a plurality of sensors aligned in a width direction of the ink ribbon.

12. A thermal printer according to claim 9, wherein said parity sub-marks are determined such that, for all rows, a total number of the sub-marks in the row is one of odd number and even number.

* * * * *